United States Patent [19]

Yanagawa

[11] Patent Number: 4,509,184

[45] Date of Patent: Apr. 2, 1985

[54] STEREO SOUND SYSTEM

[75] Inventor: Hirofumi Yanagawa, Saitama, Japan

[73] Assignee: Pioneer Electronic Corporation, Tokyo, Japan

[21] Appl. No.: 478,943

[22] Filed: Mar. 25, 1983

[30] Foreign Application Priority Data

Mar. 26, 1982 [JP] Japan ..... 57-43660[U]

[51] Int. Cl.[3] ..... H04R 5/00

[52] U.S. Cl. ..... 381/24; 381/27; 381/90; 181/144

[58] Field of Search ..... 181/144, 145, 148, 147, 181/152, 199, 146; 381/24, 27, 86, 88, 89, 90, 25

[56] References Cited

U.S. PATENT DOCUMENTS 1,855,147 4/1932 Jones ..... 181/145
3,276,538 10/1966 Guyton et al. ..... 181/148 X
4,074,083 2/1978 Berkovitz et al. ..... 381/27 X

FOREIGN PATENT DOCUMENTS 1291790 4/1969 Fed. Rep. of Germany ..... 381/88
864957 4/1961 United Kingdom ..... 381/86

*Primary Examiner*—Gene Z. Rubinson
*Assistant Examiner*—W. J. Brady
*Attorney, Agent, or Firm*—Sughrue, Mion, Zinn, Macpeak and Seas

[57] ABSTRACT

A stereo sound system for reproducing signals from two independent channels through right and left speakers. The two speakers are centrally located and propagate a lesser part of their acoustic output directly into free space. Two acoustic tunnels separately couple the major part of the outputs of the respective speakers and have their issuing ends far removed on either side of the speakers. The tunnels provide advantageous delay.

7 Claims, 7 Drawing Figures

STEREO SOUND SYSTEM

BACKGROUND OF THE INVENTION

The present invention relates to a stereo sound system that provides a good stereophonic effect for a listener who is at a position off the bisecting line of the line connecting the right and left speakers producing the stereo signals.

A stereo sound system uses two independent channels of information and produces a stereophonic effect by reproducing the respective signals from two speakers spaced apart by a predetermined distance. The conventional stereo sound system provides a good stereophonic effect for a listener who is at a position on the bisecting line of the line connecting the two speakers, but not for a listener who is at a position off that bisecting line. This presents a particularly great problem with a stereo sound system installed in an automobile where the passengers' positions with respect to the system are fixed.

An improved stereo sound system which has been proposed for solving this problem is illustrated in FIG. 1. This system is characterized by arranging five speakers, i.e. two speakers 1 and 2 for reproducing the right and left signals R and L, and three additional speakers 3, 4 and 5 positioned between these two speakers. The system also includes a divider 6 that divides the signals from the right and left channels into three portions which are supplied to the respective speakers 3, 4 and 5 from positions that correspond to those of these speakers. Because of the arrangement of the five speakers over a wide range, this improved system claims a better stereophonic effect. Furthermore, the acoustic images are evenly distributed among the five speakers and provide a good balance of sound volumes, and hence, the range where the sound is audible with a good stereophonic effect is slightly expanded.

However, unless the spacing of each speaker is increased, the volume of the sound coming from the three intermediate speakers cancel the sound from the right and left speakers to reduce the spatial distribution of the sound sources. This makes the above-described stereo sound system unsuitable for installation in a limited space such as in an automobile. An attempt has been made to produce a similar stereo sound system using three speakers, two speakers arranged on the right and left sides, and one central speaker. If the volume of the sound from the center speaker is increased in order to provide a better stereophonic effect at a position off the bisecting line of the imaginary line connecting the right and left speakers (said position is sometimes hereunder referred to as the off-line position), the acoustic image that should be oriented at the center comes slightly closer to the center, but the volume of the sound coming from the center speaker becomes so high that the sense of spatial distribution of the sound sources is reduced. Furthermore, if the listener is at the off-line position indicated by reference numeral 7 in FIG. 1, the greater part of the sound he can hear is due to the acoustic images 8 and 9 from nearby speakers, and only a weak acoustic image 10 comes from the other speaker or speakers.

SUMMARY OF THE INVENTION

Therefore, a primary object of the present invention is to provide a stereo sound system that adds only one speaker to the right and left speakers used in the conventional stereo and which expands the range affording a good stereophonic effect without reducing the spatial distribution of the sound sources.

DETAILED DESCRIPTION OF THE PREFERRED EMBODIMENTS

Figure 1:
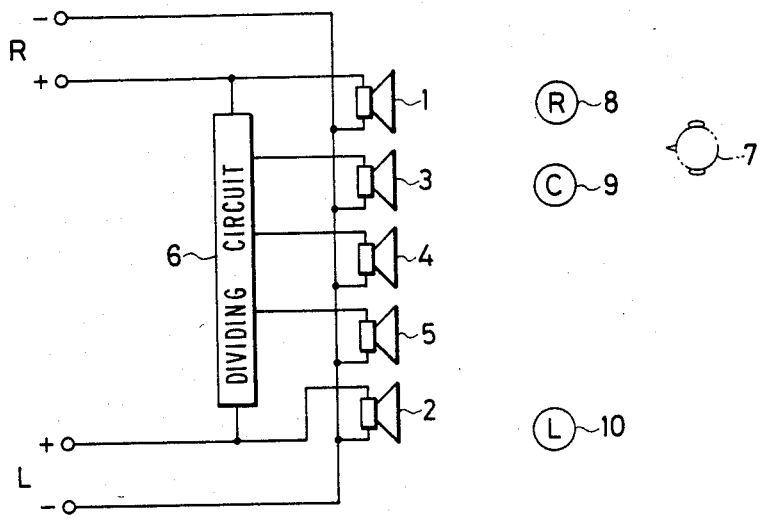
FIG. 1 PRIOR ART
FIG. 1 is a circuit diagram of a conventional stereo sound system.
Figure 2:
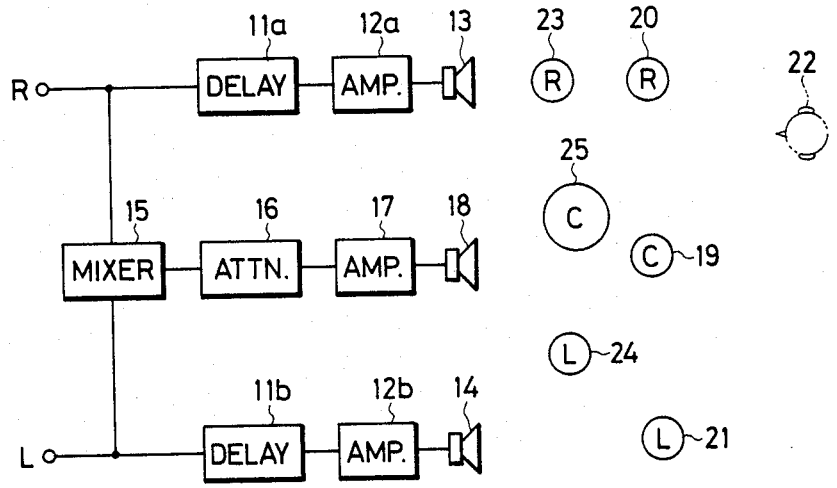
FIG. 2 PRIOR ART
FIG. 2 is a circuit diagram of another conventional stereo sound system.

One conventional stereo sound system is shown in FIG. 2 which includes a first delay circuit 11*a* for delaying the signal R in the right channel, and a power amplifier 12*a* that amplifies the output signal from the first delay circuit 11*a* and supplies the same to a speaker 13 for the right channel. A second delay circuit 11*b* delays the signal L in the left channel, and a power amplifier 12*b* amplifies the output signal from the second delay circuit 11*b* and supplies the same to a speaker 14 for the left channel. A mixer circuit 15 sums the signals R and L in phase before they are delayed, and an attenuator 16 attenuates the output signal from the mixer circuit 15 as required. A power amplifier 17 amplifies the output signal from the attenuator 16 and supplies this signal to the center speaker 18. The signals from speakers 13 and 14 that have passed through the delay circuits 11*a*, 11*b* are delayed by approximately 1 to 10 milliseconds. The attenuator 16 is set such that an attenuation of about 8 to 12 dB is achieved.

When signals R and L are supplied to the stereo sound system of FIG. 2, the right and left speakers are furnished with delayed signals whereas the center speaker 18 is provided with an undelayed signal and thus affords the listener the reproduced sound more quickly than the right and left speakers. Therefore, the reproduced sound of the signal issued from the center speaker 18 after summation of the signals from the right and left channels reaches the listener faster than the reproduced sound of the signals issued from the right and left speakers 13 and 14 representing the individual signals from the right and left channels. This means that the sound reproduced from the center speaker 18 becomes a "Preceding" sound and is properly oriented with respect to the sound reproduced from each of the speakers 13 and 14. As a result, the central acoustic image 19 can be positioned a substantially equal distance from the right and left acoustic images 20 and 21 without increasing the volume of the sound reproduced from the center speaker 18. The sound reproduced from the center speaker 18 does not diminish the spatial distribution of the sound sources and a good stereophonic effect can be enjoyed by a listener 22 who is at a position some distance away from the center toward the right side. If the delay time for the right channel signal is equal to that for the left channel signal, the same good stereophonic effect is obtained at positions which are off-center toward the right and left sides by an equal distance. The delay time for each signal may be adjusted depending upon the specific position of the listener.

If the signals from the right and left channels are not delayed and if the signal running to the center speaker is not attenuated, the right, left and central acoustic images are not properly oriented as indicated by 23, 24 and 25, respectively, in FIG. 2; the left acoustic image 24 is some distance away from its proper position toward the right side, and at the same time, the central acoustic image 25 is also away from the center some distance toward the right side and its volume is relatively high. As a result, the overall reproduced sound does not have good spatial distribution of the sound sources or a good stereophonic effect.

The conventional stereo sound system of FIG. 2 may be installed in an automobile, or may be used at home or in broadcasting stations. The mixer 15 and attenuator 16 may be combined into a signal unit.

For installing the stereo sound system of FIG. 2 as a car accessory, the right and left speakers may be connected to separate pipes or conduits, but instead, the heat duct may be used as an acoustic tube. In the case of an automobile where the heat duct is also used as a defroster, the blow-off port connected to the defroster should not be close enough to the center speaker to reduce stereophonic separation. The sound issued from the speaker connected to the acoustic tube is delayed by l/c wherein l is the acoustic length of the acoustic tube (i.e. the distance between the speaker and the issuing end of the acoustic tube) and c is the velocity of sound. If l is 68 cm, the delay time is 2 milliseconds.

Embodiments of the stereo sound system of the present invention are hereunder described with reference to FIGS. 3A, 3B, 4A, 4B and 5. The embodiment of FIG. 3 includes the left speaker 111, the right speaker 112, a sound issuing end 115 for the left speaker, an acoustic tunnel 118 for the left speaker, a sound issuing end 116 for the right speaker, an acoustic tunnel 119 for the right speaker, and the issuing ends 114 and 117 of the left and right acoustic tunnels, respectively. The mixture of sound waves radiated from adjacent issuing ends 115 and 116 corresponds to the sound issued from the center speaker 18 in FIG. 2. A device corresponding to the mixer 15 of FIG. 2 can be mechanically established by placing the two sound issuing ends 115 and 116 close to each other. A device corresponding to the attenuator 16 of FIG. 2 can be acoustically established by selecting the proper ratio of the cross-sectional area of the issuing end 115 (116) to that of the acoustic tunnel 118 (119) connected to that issuing end. The sound radiated from the issuing end 114 (117) is delayed by a duration equal to the acoustic length $l_L$ ($l_R$) of the acoustic tunnel 118 (119) divided by the velocity of sound. Therefore, the issuing ends 114 and 117 correspond to the speakers 14 and 13 of FIG. 2, respectively. The acoustic length $l_L$ need not be equal to $l_R$.

Figure 3A:
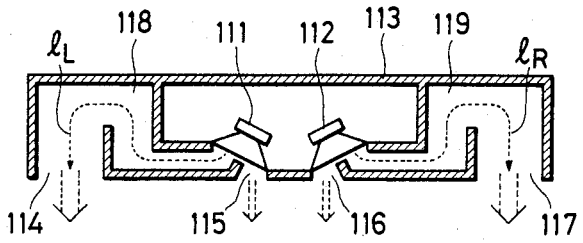
FIGS. 3A and 3B are schematic representations of the stereo sound system according to another embodiment of the present invention, FIG. 3A in top sectional view and FIG. 3B in view.
Figure 3B:
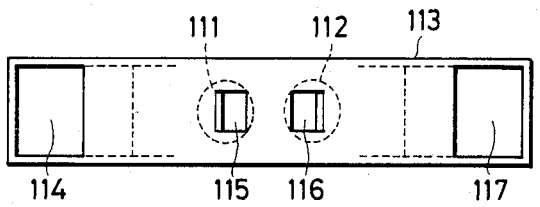
Figure 4A:
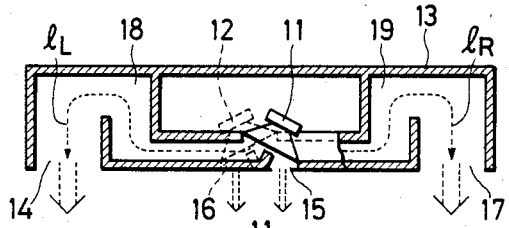
FIGS. 4A and 4B are schematic representations of still another embodiment, FIG. 3A in top sectional view and FIG. 3B in front view, wherein the speakers are vertically arranged.
Figure 4B:
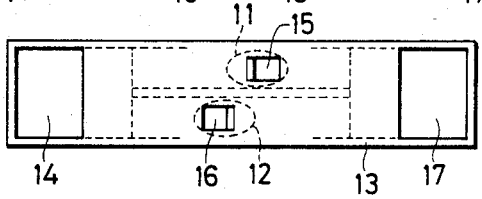

FIGS. 4A and 4B show a second embodiment of the stereo sound system of the present invention which is substantially similar to that of FIGS. 3A and 3B, but wherein the speakers are arranged vertically.

Figure 5:
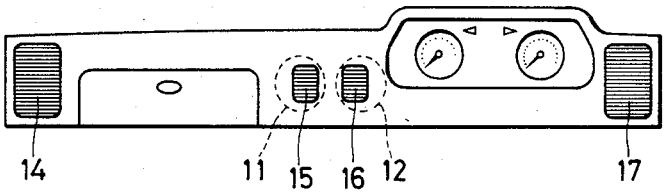
FIG. 5 shows a further embodiment of the present invention wherein the speakers are installed in the dashboard of an automobile.

FIG. 5 shows a third embodiment wherein the stereo components are not enclosed with a cabinet in a module configuration, but speakers 11 and 12 are installed on the dashboard of an automobile, with the respective sound issuing ends 14, 15, 16 and 17 being mounted as shown and only the acoustic tunnels being attached separately.

According to the embodiments of FIGS. 3A to 5, the desired spatial distribution effect can be achieved without any special circuitry.

What is claimed is:

1. A stereo sound system for reproducing signals from two indlependent channels, comprising:

right and left speakers;

center means for summing in phase and attenuating the acoustic outputs of said right and left speaker and radiating said summed attenuated signals; and right and left acoustic tunnels having input ends facing at least a portion of said right and left speakers respectively and sound issuing ends located on the right and left sides respectively of said center means, said tunnels delaying signals propagating from said input ends to said sound issuing ends.

2. A sound system as claimed in claim 1, wherein said mixer means comprises means for establishing a relatively small spacing between said sound issuing ends of said right and left speakers.

3. A sound system as claimed in claim 1, wherein said attenuator means comprises means for establishing a proper cross-sectional area ratio between, respectively, said sound issuing ends of said right and left speakers and said right and left acoustic tunnels.

4. A stereo sound system for reproducing signals from two independent channels, comprising:

a right speaker; p1 a left speaker closely adjacent said right speaker;

a right acoustic tunnel with a sound issuing end situated substantially to the right of said right speaker;

right acoustic dividing means for dividing the acoustic output of said right speaker between said right tunnel and that radiated directly from said right-speaker;

a left acoustic tunnel with a sound issuing end situated substantially to the left of said left speaker; and left acoustic dividing means for dividing the acoustic output of said left speaker between said left tunnel and radiated directly from said left speaker.

5. A stereo sound system as recited in claim 4, wherein said left and right acoustic dividing means cause a lesser portion of the acoustic output of said speakers to radiate directly from said speakers.

6. A stereo system as recited in claim 4, wherein said left and right speakers are horizontally arranged with respect to each other.

7. A stereo system as recited in claim 4, wherein said left and right speakers are substantially vertically arranged with respect to each other.

* * * * *